United States Patent [19]

Block et al.

[11] 4,286,498

[45] Sep. 1, 1981

[54] DECOY ROUNDS AND THEIR METHOD OF FABRICATION

[75] Inventors: Kenneth A. Block, Claremont; William M. Carter; George H. Schillreff, both of Glendora, all of Calif.

[73] Assignee: General Dynamics, Pomona Division, Pomona, Calif.

[21] Appl. No.: 515,493

[22] Filed: Dec. 21, 1965

[51] Int. Cl.[3] ..... F42B 33/10

[52] U.S. Cl. ..... 86/1 R; 102/505; 149/21; 149/42; 343/18 E

[58] Field of Search ..... 86/1, 1 R; 102/26, 98, 102/37.6, 70, 89 CD, 99; 149/21, 42; 343/18 B, 18 E

[56] References Cited

U.S. PATENT DOCUMENTS

| | | | |
|---|---|---|---|
| 954,591 | 4/1910 | Rogers | 102/37.6 X |
| 3,081,704 | 3/1963 | Boswell | 102/89 X |
| 3,095,814 | 7/1963 | Jansen et al. | 102/37.6 X |
| 3,183,133 | 5/1965 | Lenke | 149/42 X |
| 3,301,721 | 1/1967 | McCoy et al. | 149/21 X |

*Primary Examiner*—Harold J. Tudor
*Attorney, Agent, or Firm*—Lafayette E. Carnahan; Edward B. Johnson

[57] ABSTRACT

This disclosure relates to countermeasure systems, particularly to systems for providing a protective cover against homing and/or fire control devices operating upon infrared, sonar, or microwave reflected energy or for confusing search and tracking devices, and more particularly to decoy rounds and their method of fabrication. The decoy rounds include at least one load of energy generating material, means for propelling the load, a burst charge for shattering the load, the burst charge being constructed so as to cause a line type explosion, and means for igniting the burst charge. The decoy rounds are fabricated by a process which includes a novel method of producing the line type explosion and includes a novel assembly operation which allows the round to be exploded in such a way that birdnesting of the decoy material is minimized.

9 Claims, 7 Drawing Figures

Igniter Train 36
Aluminum Chaff 29
Explosive Dispersing Charge 28
Electric Squib 35
Time Delay Fuze 33
Phenolic Tubing 26, 27
Lift Charge 39

DECOY ROUNDS AND THEIR METHOD OF FABRICATION

This invention relates to countermeasure systems, particularly to systems for providing a protective cover against homing and/or fire control devices operating upon infrared, sonar, or microwave reflected energy or for confusing search and tracking devices, and more particularly to decoy rounds and their method of fabrication.

This invention relates to the invention disclosed and claimed in copending U.S. Patent Application Ser. No. 389,525 entitled "Counter Measures System" and assigned to the same assignee. While the above mentioned application is directed to a system for dispensing infrared, sonar, or microwave-reflected energy or combinations thereof by firing a projectile or a plurality thereof and dispensing the same at a predetermined point in time or position along its trajectory or path of travel, this invention is more particularly directed to decoy rounds of the above energy types and the method of fabricating the rounds and particularly the burst charge for exploding the round. Thus, the decoy rounds of this invention serve as a protective cover by confusing sensing mechanism of incoming missiles or the like and/or a means for confusing search and tracking radars. These rounds are particularly adapted for utilization in launching mechanisms which can be located on land, sea-born vehicles, underwater vehicles, or air vehicles.

Therefore, it is an object of this invention to provide decoy rounds.

A further object of the invention is to provide a method of fabricating decoy rounds.

Another object of the invention is to provide a novel burst charge for decoy rounds and its method of fabrication.

Another object of the invention is to provide decoy rounds and a completely self sustained launch mechanism therefor, whereby the rounds can be fired singly, in salvo, or simultaneously.

Another object of the invention is to provide means for confusing energy sensor systems, particularly those operating on microwave reflected energy.

Another object of the invention is to provide a simple and inexpensive decoy round which effectively dispenses material for confusing sensor systems.

Another object of the invention is to provide a decoy system using low-cost, easily-handled rounds which provide added defense and attack support for land, sea and air operations.

Other objects of the invention, not specifically set forth above, will become readily apparent from the following description and accompanying drawings wherein.

The decoy rounds produce targets and generate confusion in search, tracking, and homing weapons. The fast reloading capability of the launcher system using spare loaded round containers provides protection both during attach or during retreat. The various types of rounds are designed to operate with respect to a ship, for example: (1) close to the ship to confuse the ranging elements of homing weapons; (2) far enough away to minimize blast damage to the ship from weapons centered on the decoys; (3) low to appear near sea level to long distance search weapons; (4) sufficiently high to have adequate persistence for the tactical encounter; (5) deep enough to cover the distance from the surface of the water to below the first thermal layer; and (6) sufficiently large to duplicate the target size of the smallest fighting unit. Generation of larger targets to simulate larger craft may require several rounds fired at close intervals. In addition, the decoy rounds may be fired from air vehicles or land installation to confuse search and tracking devices located a substantial distance away or over the crest of a hill or the like. Decoy rounds utilizing the harmonic generating chaff are particularly effective in that they not only reradiate the frequencies of an active source but additionally radiate frequencies which are not transmitted by the active source, thus creating the illusion of more than one independent source.

Figures 1, 2, 3, 4:
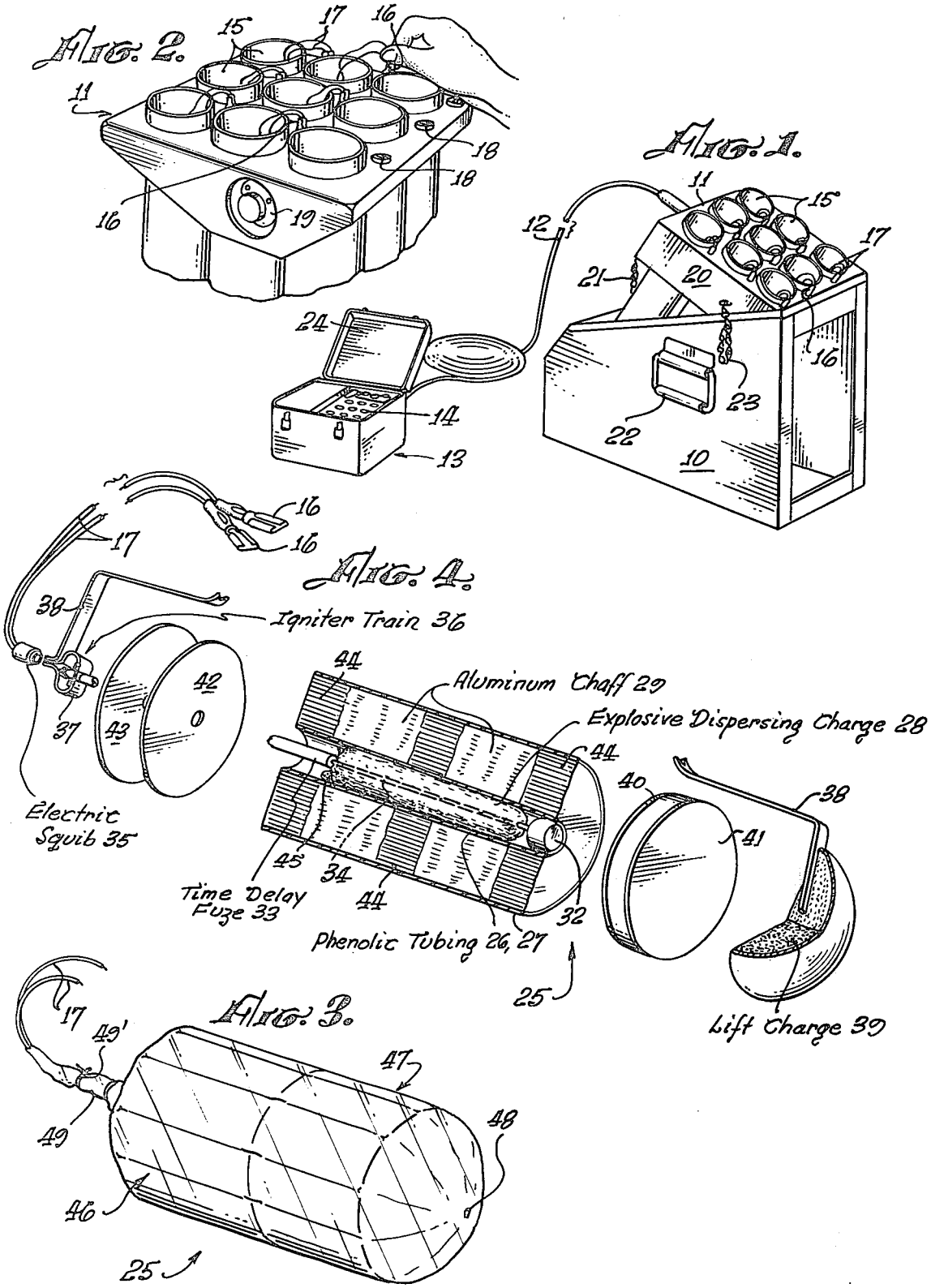
FIG. 1 is a perspective view illustrating an embodiment of self sustained launch mechanism for launching decoy rounds made in accordance with the invention.
FIG. 2 is a view partially illustrating the decoy round container unit of the FIG. 1 mechanism illustrating the interconnection of the squib wires from the rounds to the launcher mechanism.
FIG. 3 is a perspective view of an embodiment of a decoy round made according to the invention.
FIG. 4 is a partially exploded, partially cross-sectional view of the FIG. 3 round with portions being omitted to illustrate the interior of and assembling procedure for the round.

Referring now to the drawings, a self sustained launcher mechanism, as illustrated in FIG. 1, capable of launching the FIG. 3 round, for example, generally consists of a base 10, a multiple-round container unit or launcher-magazine 11, a firing cable 12, and a power-control unit 13.

Since this invention is not directed to the specific details of the launching mechanism, only the general description and operation of the mechanism will be described herein.

The complete launcher mechanism of FIG. 1 can be carried easily aboard a ship and set up in locations compatible with normal ship operation or positioned at any desirable land location or aboard a land vehicle. The base 10 may be constructed of steel, for example, and is held in place by appropriate weights such as sandbags or the like (not shown) to dampen the recoil from firing. For rough sea or land operations lashing or bolting of the base 10 to the ship or vehicle may be required. The round container unit 11 can be protected prior to firing, if desired, by a watertight or dustproof cover (not shown). The rounds are fired manually by the push buttons 14 in the power-control unit 13. Spacing of the firing sequence of the rounds depends upon the tactical situation.

To load the round container unit 11, rounds such as that illustrated in FIG. 3 are inserted into the launch tubes 15 (see FIG. 2). Spring clips 16 on squib wires 17 from the rounds are connected to the pin sockets 18 adjacent the tubes 15 which in turn are connected via multi-terminal plug 19 and cable 12 to power-control unit 13, thus completing the circuit. The entire loading operation of a container unit 11 can be accomplished in less than two minutes while changing containers 11 in the base 10 takes about 15 seconds.

As can be readily seen from FIG. 1, the construction of the base 10 and its hinged top or retainer frame 20 allows insertion of the loaded round container 11 into base 10 with the tubes 15 pointing away from the loading personnel, thus providing a safety factor. The hinged retainer frame 20 is secured to base 10 via a chain 21 and an over-center clamp (not shown). While not shown, frame 20 is provided with an aperture to allow cable 12 to be inserted into plug 19, thus the connection between plug 19 and cable 12 can only be made after the container 11 is clamped in the base 10. If the container 11 is loaded while in the base 10, the firing cable 12 should be disconnected for added safety. Base 10 also is provided with handles 22 (only one shown) for carrying same and with a chain 23 connected to top or retainer frame 20.

The firing cable 12 is impervious to water and highly resistant to damage through normal use. It is provided with a quick connect plug on each end which provides connection between the round container 11 and the power-control unit 13. The plugs on cable 12 are identical and the wiring is arranged so that the cable is reversible.

The rounds are fired by electric impulse from a standard 6 volt battery, for example, contained in the control unit 13. Also, the unit 13 contains a test circuit which illuminates a green light if the battery has enough power to fire the rounds. In addition, unit 13 includes a switch and switch guard so arranged that when the guard is lifted the switch can be thrown from the safe to the arm position. In the arm position a red light is illuminated and the system is ready for firing.

As pointed out above, the rounds are fired manually by depressing the push buttons 14 on the control panel of unit 13. The correspondence of the push buttons 14 to the launch tubes 15 may be such that when both are viewed from the top the round container plug 19 and the top of the push buttons 14 are in the same relative position.

When the lid 24 of the unit 13 is closed, the switch guard is pushed down thus throwing the switch to the safe position assuring a visible safety check when changing round containers or inserting rounds in tubes 15. The unit 13 is sturdy, compact, and water resistant.

The round 25 illustrated in FIG. 3 and adapted for the launch tubes 15 of the FIGS. 1 and 2 launcher mechanism may be, for example, about 2¾ inches in diameter and about 8 inches long overall. The rounds may be protected by plastic bags during shipping, storing, and firing. For firing, the top of the bag may be slit and the two lead or squib wires 17 removed and uncoiled, then the package; namely, round and bag is inserted into the launch tube 15. As more specifically described hereinafter, an electric squib in the round 25 ignites simultaneously both a lift charge and a time fuse. The lift charge propels the round from the launcher in a ballistic trajectory. The time fuse ignites a burst charge which disperses the payload at the optimum point for the type of round being used.

In order to provide a greater understanding of the function of the decoy rounds and the technical considerations pertinent to the decoy system of this invention, the following is set forth ahead of the detailed description of the rounds and their fabrication and assembly.

The decoy round requirement for a destroyer installation, for example, includes the following considerations: (1) the number of rounds that must be fired to accomplish their purpose; (2) the time interval between successive rounds within the firing ripple; (3) the explosive characteristics of the dispersal charge; (4) the frequency characteristic of the chaff dipoles; (5) the packing density, quantity, and orientation of the dipoles within the decoy package; (6) the time required for target buildup; (7) the maximum target size; (8) the polarization characteristics of the chaff blossom; and (9) the intensity and time persistence of the chaff target.

In order to more easily describe the processes and technical characteristics of the decoy round each item will be summarized and discussed as a separate characteristic but it should be noted that the decoy effectiveness results from their total and from their interaction.

The number of rounds that must be fired to accomplish a specific purpose has been empirically determined from many actual sea tests. The number varies considerably depending upon the size of the decoy launching ship or vehicle and upon the type of radar or weapon that the decoy is expected to combat. The actual numbers found to be effective for a specific purpose vary from one to twenty-five rounds. For small installations the launcher embodiment illustrated herein may be utilized. For large installations a 25-tube launcher may be installed as a portable unit or as a permanent installation with firing control in CIC wherein intervalometers allow firing in volleys at 0.1 to 0.5 seconds intervals, for example. For large installation, for example, on a destroyer, 25 round volleys may be fired for confusing search radars or creating false targets and 50-round volleys may be used against fire control radars and homing systems.

The time interval between successive rounds within the firing ripple is dependent upon three basic parameters: (1) the type of radar that the decoy is working against; (2) the launching vehicle's speed; and (3) the wind speed. For example, a ship steaming at 17 knots into a 13 knot wind while firing decoys at 4 or 5 second intervals can develop a very large chaff cloud. If a search radar and a fire control radar are simultaneously observing the cloud soon after it is launched it will appear different to each radar. The search radar will see a large target but not out of proportion to other targets in the area. The fire control radar will see many discrete targets at first but later the cloud will expand and the radar will be able to scan and measure the volumetric dimensions of the large chaff cloud, i.e., elevation, train, and range. The search radar, at this time, will also see a very large target.

Thus it may be seen that the time dependent effects of the decoy must be applied to the dynamic characteristics of the victim radar. Test results show that a fire control radar will observe and react to the explosive dispersal of the decoy chaff. The automatic gain control and tracking loops within the radar will reflect the chaff burst impulses and exhibit a noisy tendency toward drift. Immediately following this initial transient condition the radar is presented with a fairly large chaff target which it now prefers to the noise impulses and steady, smooth chaff tracking is carried on for the life of the decoy cloud. Physical separation of the chaff cloud and the ship is initiated and acceptable miss distance is developed.

The explosive characteristic of the novel dispersal charge accomplishes two principal objectives. The first, to react very rapidly as a "line" explosion as opposed to a "point" explosion of other decoy systems. It is necessary to shatter the decoy package in a cylindrical fashion and begin transportation of the dipole mass (chaff) without discontinuities in order to achieve minimum "birdsnesting" and maximum rate of chaff cloud buildup. This is of even more importance for dipoles of longer lengths such as S-band and L-band. The second important characteristic of the burst explosive is the combination of ingredients which develops a very high velocity shock wave, an extra high temperature fireball, and altogether, an explosive and temperature lifetime of short duration. The high velocity explosion ruptures the frangible round packaging without undue damage to the payload. The very high temperature fireball quickly creates a large volume of ionized gas which acts as a radiating source as well as a radar reflective target. In addition, the expanding dipole mass acts as a metallic reflector prior to the time that dipole resonant reradiation occurs. The very short lifetime of the explosion prevents incendiary action and destruction of the aluminum dipoles. Thus, the explosive dispersal charge acquires the initial attention of the victim radar.

The frequency characteristic of the chaff dipoles is determined from the operating frequencies of the specific radars that the decoy will be used against. The dipole lengths are cut to resonate at the desired frequencies and the relative proportion and totals of the different dipoles are adjusted so as to provide the desired frequency coverage and amplitude response.

The packing density, quantity, and orientation of the dipoles within the decoy round package are important factors that must be controlled to obtain an effective and rapid development of radar reflective area from the chaff explosion. The packing density is critical with respect to "birdsnesting" and explosive compression. If the density is too high the chaff will pack and birdsnest; if the density is too low there will be more absorption of the explosive dispersal charge and the frangible package will not satisfactorily disperse. The quantity and orientation of the dipoles are factors that are subject to tradeoffs because of the restrictions in available space, weight, and shape factor within the decoy round itself. The dipole frequency, or length of the cut, together with the factors of density and dispersal efficiency largely determine the numbers and orientation that constitute a single section of the chaff package. In order to increase the target amplitude more sections are then added to the package until the available volume is occupied.

The time required for target buildup is one of the more important characteristics of the decoy round because of the subtile processes involved in capturing a fire control radar. The process of capture in addition to the above description is due to the blossoming chaff cloud which exhibits an appreciable target within the first few seconds.

The maximum target size that a single decoy round will develop is dependent principally upon the characteristics built into the round and somewhat upon the viewing aspect and wind conditions. In order to further increase the target size of the chaff cloud more rounds can be fired. The increase in target size is not directly proportional to the number of rounds but increases gradually until the chaff cloud becomes saturated with dipoles and significant radar shadowing effects occur.

In general, the practical limits imposed by time, wind, and ship speed restrict the target size to the order of 10,000 square meters.

The polarization characteristics of the chaff blossom are necessary to control to the extent that both vertical and horizontal compenents must be present in the cloud in order to prevent polarization selection by the enemy radar. Test results show that the decoy cloud exhibits nearly equal vertical and horizontal polarization. There is a change from the equality near the end of the life of the chaff cloud. This change is also dependent upon the wind conditions and the viewing aspect of the cloud.

The intensity and time persistence of the chaff target are separate and are determined by two physical factors. The intensity is the result of the number, timing, and spacing of the decoy rounds launched. Whereas, the time persistence depends upon the shape and weight of the individual dipoles as well as the wind supporting effects. The intensity and time persistence of the decoy rounds has been found to be more than adequate to accomplish their intended purpose.

Referring now to the embodiment of the decoy round illustrated in FIGS. 3 and 4, which is adapted to be launched from the mechanism illustrated in FIGS. 1 and 2, the round generally comprises phenolic tubing 26 and 27, tubing 26 being positioned within tubing 27 and designed to retain an explosive dispersing or burst charge 28 which disperses the aluminum chaff 29 contained intermediate tubing 26 and 27. A plug 32 is positioned within one end of tube 26, and in abutment with burst charge 28. Extending through a central aperture in the opposite end of tube 26 is a time delay fuse 33, in this embodiment of a 5 second delay type, which extends into the burst charge 28 and is operatively associated with a "black match" indicated in phantom at 34 which extends through the length of charge 28. The "black match" may be constructed of a 12-ply cotton twine coated with black powder. The "black match" 34 assures rapid "line" detonation. Connecting time delay fuze 33 to an electric squib 35 is an igniter train 36 which includes a section 37 connected to fuze 33 and a section 38 connected to a lift charge 39. Squib 35 is connected with the lead squib wires 17 which are connected to round container 11 for the purpose described above with respect to the description of FIGS. 1 and 2. The lift charge 39 is separated from the plug 32 by a pair of discs 40 and 41 and paper wrapping material (not shown) but described hereinbelow. Another pair of discs 42 and 43 and associated wrapping paper (not shown) separate the igniter train 36 from the opposite end of tube 26. The embodiment of the round 25 shown in FIG. 4 consists of two sections of chaff 29 of S-band and C-band separated from each other and from the end covers by sections of X-band chaff indicated at 44. However, as described above, the various sections of chaff may be interchanged or the entire round may be composed entirely of either C-band, S-band, or X-band chaff, if desired.

As clearly pointed out above one of the novel features of this invention is the dispersal or burst charge 28 which provides very fast reaction and a very rapid "line" explosion which shatters the decoy round 25 in such a manner as to begin transportation of the dipole mass (aluminum chaff) 29 without discontinuities in order to achieve minimum "birdsnesting" (bunching) of the chaff and provides maximum chaff cloud buildup rate. The burst charge 28 is composed of the following ingredients:

5 parts potassium perchlorate by weight.

2 parts black aluminum by weight.

These ingredients are mixed as follows:

1. Screen the potassium perchlorate through a number 20 screen.
2. Mix the potassium perchlorate with the black aluminum in the above ratio of 5 parts by weight to 2 parts by weight respectively.
3. Screen the above mixture three times through a number 20 screen.

The thus mixed ingredients are contained in a paper tube indicated at 45 in FIG. 4 that just fills the internal diameter of the tube 26 around which the chaff load 29 is positioned. The "black match" 34 is inserted into the tube 45 such that it extends the length of the tube. The time fuze 33 is placed in the top of the paper tube 45 and securely tied such as with twine. The tube 45 containing burst charge 28 is contained securely inside the chaff load with cardboard discs, lacing, and glued paper, in a manner which will become more readily apparent hereinafter, to contain the explosion for proper dispersion of the load.

The FIG. 3 decoy round 25 is assembled as follows:

1. The wood plug 32 is glued in the one end of the tubing 26 as shown in FIG. 4.

2. With the chaff load 29 contained intermediate the phenolic tubing 26 and 27 as shown in FIG. 4, the thus assembled unit is wrapped and glued in two layers of kraft paper with enough paper extending past the end covers to cover the ends when folded.

3. The burst charge tube or package 45 is inserted into the cavity of tubing 26 and in abutment with plug 32.

4. Cardboard discs 40 and 42 are inserted into the thus extended paper ends and into abutment with the respective ends of the load, and the paper folded over the discs.

5. The outer cardboard discs 41 and 43 are placed on each end over the folded paper and the load is laced with twine.

6. The load is wrapped with another two layers of kraft paper, ends folded over and glued as indicated at 46 in FIG. 3.

7. The igniter train 36 is laid along side of the thus wrapped load and another wrap of paper is made from the half-way mark of the load extending out past the end containing the plug 32 and discs 40 and 41 as indicated at 47 in FIG. 3.

8. The lift charge 39 is poured in and the paper collected together and tied (see 48 in FIG. 3). The lift charge 39 may be composed of conventional flash powder with the type and amount being dependent on the specific application.

9. A paper tube indicated at 49 is placed over the time fuze 33 and the end of the section 38 of igniter train 36 coming from the lift charge and tied close to the top of the load.

10. The electric squib 35 is placed in the open end of the thus defined paper tube in operative connection with train 36 and tied at 50, thereby producing the round 25 of FIG. 3 which is ready for shipping, storing or firing. If desired, the round 25 may be inserted into a protective plastic bag.

The wood plug, cardboard discs, wrapping and lacing are important so as to properly contain the burst charge and to isolate the lift charge from the burst charge. The igniter train, squib and time fuze must be contained in the paper tube away from the air to assure proper operation thereof.

Figure 5:
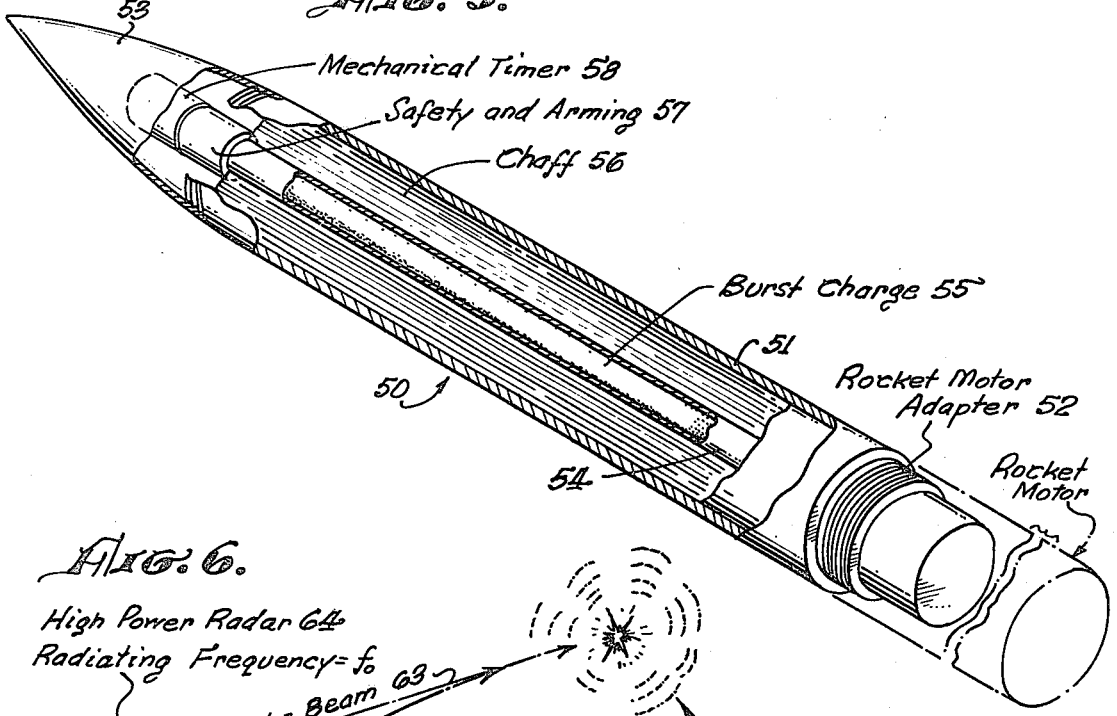
FIG. 5 is a view of another embodiment of the inventive decoy round with portions being cut away to illustrate the internal components thereof.

While the embodiment of the decoy round 25 illustrated in FIGS. 3 and 4 is adapted for relatively short range applications the FIG. 5 round is adapted for launch from either land, water craft, or aircraft by a weapon such as the convention 2.75 rocket, thus providing a longer range of applications of several miles. Referring now to FIG. 5, the round indicated at 50 generally comprises a casing or phenolic tube 51 having a rocket motor adapter 52 operatively connected at one end and a nose cone 53 operatively connected at the opposite end. A central hollow tube 54 extends throughout the length of casing 51 and contains a burst charge 55 described in detail hereinafter. Contained intermediate the casing 51 and central tube 54 is the aluminum chaff 56. Operatively connected to the burst charge 55 and positioned within nose cone 53 is a safety and arming device 57 and a mechanical timer 58. Since this invention is not directed to either of the devices 57 or 58, a detailed description is deemed unnecessary except to state that they function to activate the burst charge 55 and thus disperse the chaff load 56 in the manner described above.

As in the FIG. 3 embodiment, the burst charge 55 is one of the novel and unique features of this invention which provides a "line" explosion as opposed to the "point" explosion of known decoy rounds. The burst charge of the FIG. 5 embodiment differs from that of the FIG. 3 embodiment in ingredients and in that the ingredients of the FIG. 5 embodiment burst charge are of the granulated type. The ingredients of burst charge 55 are as follows:

5 parts potassium perchlorate by weight.
2. parts black aluminum by weight.
$\frac{1}{4}$ part yellow dextrin by weight.
$\frac{1}{2}$ quart water These ingredients are mixed as follows:

1. Screen the potassium perchlorate through a number 20 screen.

2. Mix the black aluminum and yellow dextrin with the screened potassium perchlorate in the above by weight proportions.

3. Screen the mixture three times through a number 20 screen.

4. Place the mixture in a container, add the water, and mix by hand.

5. Push the mixture of step 4. above through a $\frac{1}{8}$ inch screen every 4 hours until the mixture is dry.

The granulated charge ingredients as mixed above are contained in a paper tube (not shown) that just fills the cavity in the central tube 54 of round 50. A "black match" of the type described with respect to the FIGS. 3 and 4 embodiment, is inserted so as to extend the length of the tube, thus assuring a "line" explosion. The tube is tied into four (4) equal segments with the black match extending out of the end adjacent the safety and arming device 57 so as to engage the firing mechanism of said device 57. This package is placed inside the cavity of tube 54 and secured with glued cardboard discs as described below. Granulation of the powder and segmenting the burst charge package prevents shifting and packing of the charge under high acceleration created by firing the round 50 from a rocket or similar type weapon.

The decoy round 50 of FIG. 5 is assembled as follows:

1. The chaff load 56, which in this embodiment is 4 times greater than that of the FIG. 3 embodiment, is contained intermediate tube 54 and casing or phenolic tube 51, casing 51 extending on both ends beyond the chaff and center tube to accommodate interconnection with adapter 52 and nose cone 53.

2. The rocket motor adapter is glued in one end of casing 51.

3. The burst charge package is inserted into the center tube 54 and secured by gluing cardboard discs into place over the end thereof.

4. The nose cone 53 containing the adjustable mechanical timer 58 and the safe and arming device 57 is glued into place so that the firing mechanism of the device 57 is in engagement with the extending end of the "black match" of the burst charge package.

The timer mechanism 58 is set for the proper range. When the rocket motor is fired, an acceleration sensing element in the safe and arming device 57 activates the timer 58. After the proper number of seconds for time-in-flight, a firing pin of the device 57 ignites the "black match" to the burst charge causing a "line" explosion and the chaff load 56 is dispersed in the manner set forth hereinbefore.

It is thus seen that the FIGS. 3 and 5 embodiments provide both short and long range capabilities for dispensing decoy materials for confusing microwave sensing devices.

The chaff loads of either the FIG. 3 or the FIG. 5 embodiments may include harmonic generating chaff that produces a passive source, physically displaced from the active source, which radiates frequencies which are not transmitted by the active source, thereby creating the illusion of two or more independent sources. The known decoy devices reradiate only the same frequency as the active source. Thus the decoy chaff of this invention radiates spurious frequencies, harmonics and noise, in addition to reradiating the fundamental frequency. These spurious frequencies may be used to decoy missiles, inactivate fuzes, jam radars and communication receivers which are susceptible without revealing the nature of the vital defended element. This type of chaff of lower fundamental frequencies may be employed to jam harmonically related receivers over many octaves. The chaff may be localized in the vicinity of an attack or enemy element so that his radiation jams his own electronics. The presence of spurious frequencies could cause the enemy to reduce his jammer power density in an effort to blanket a wider spectrum. Also the harmonic generating chaff may be utilized in automatically repeating communications on several frequencies, which may be received nearby or over the horizon or terrain obstructions as a result of the altitude of the chaff.

Figure 6:
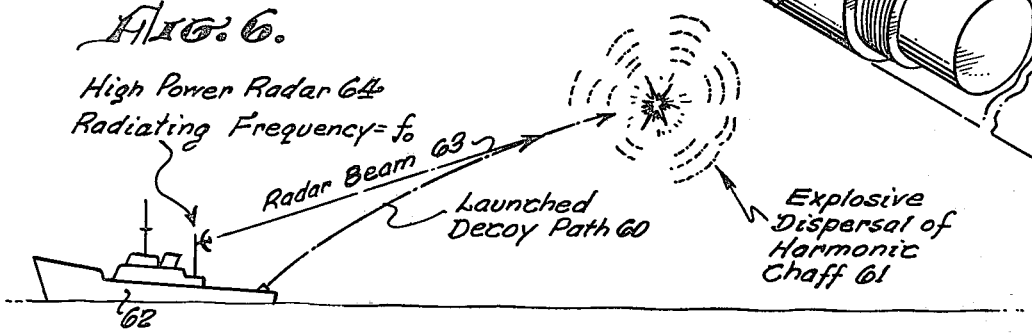
FIG. 6 is a view illustrating the application of another embodiment of the inventive decoy round containing harmonic generating chaff.

FIG. 6 illustrates an example of the utility of the harmonic generating type chaff. As shown a decoy round of, for example, the FIG. 3 type, is launched along the flight path 60 by the FIG. 1 mechanism and exploded as a protective cover 61 to a ship 62. The radar beam 63 from a high power radar 64 which radiates a frequency of $f_o$ strikes the dipoles of the harmonic chaff. The dipoles reradiate the original frequency $f_o$. In addition the dipoles radiate frequencies of 2 $f_o$, indicated by the dotted curved lines, and 3 $f_o$, indicated by the curved dot-dash lines, etc., plus noise (random) components and the cross products of the various frequencies. The various frequencies are radiated as an omnidirectional source. Interference results from the random unwanted frequencies as they may be received by radar or radio receivers. The FIG. 6 illustration shows how to create a false target to a radar or homing system attacking the ship 62.

Figure 7:
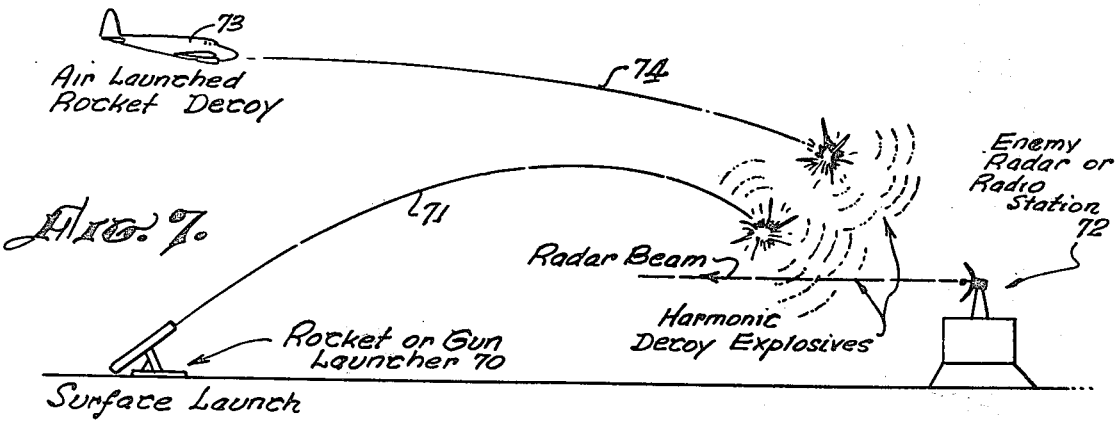
FIG. 7 is a view illustrating another application of the harmonic chaff type decoy round.

FIG. 7 illustrates an example of the utility of the harmonic generating type chaff when used in a long range round of the type shown in FIG. 5. As shown, a decoy rocket type round is launched from a surface mounted launcher 70 along a flight path 71 and exploded in enemy territory adjacent a radar or radio station 72 or as an air launch from aircraft 73 along path 74 and exploded in the area of station 72. The r-f interference created by the decoy would disrupt the operation of the radar or radio set. The means of interference would be by the same means as described with respect to FIG. 6, i.e., radiation from the enemy set 72 would strike the chaff dipoles and develop unwanted harmonics and noise.

While not illustrated, a decoy round containing the harmonic generating type chaff can be effectively utilized for the propagation of an interference that is not line of sight due to a mountain, hill or other terrain obstruction. This is accomplished by exploding the decoy round so that it is in line of sight between the two stations on opposite sides of the obstruction at the point of burst. By radiating high power energy from the friendly source to the chaff cloud whereby reradiation will then occur and will be received by the station located behind the obstruction. The interference affects the station in the manner as described above.

It is thus seen that the decoy rounds of either the FIG. 3 or the FIG. 5 embodiments may be provided with the conventional type chaff or with the harmonic generating type chaff, thus providing a great variety of decoy capabilities.

While the specific description has been primarily directed to microwave reflected energy type decoy rounds, the rounds may include a payload for duplicating infrared (IR) target signals of various size targets or a payload of tablets of material such as lithium hydride which may be dispersed over the surface of the water or under the water surface to produce bubble columns for confusing sonar and acoustic homing devices. These modifications may be readily accomplished by replacing the aluminum chaff with bubble producing pellets, or infrared generating material, or any combination of the three types, which can be launched and dispersed in the same manner as above described. Also, rounds may be fired from the air, surface or underwater launchers which contain a gas producing material, such as lithium hydride, for buoyantly supporting a mass of energy generating material on the water surface to simulate periscopes or other false surface targets. In addition, the energy generating rounds may be arranged and fired in the piggy-back or Roman candle type style.

Thus, the decoy rounds of this invention may be used against radar, infrared, and/or underwater search, tracking, and homing weapons. This is accomplished by firing a round or a plurality thereof and dispersing the same at a predetermined point in time or position along the trajectory or path of travel, whereby these additional energy sources confuse the sensor system of search, tracking, or homing devices. This is more effectively accomplished because the burst charge of the decoy rounds provides a "line" explosion instead of the prior known "point" explosion which shatters the round in such a manner as to more effectively disperse the chaff or other decoy energy in the desired pattern. Therefore, this invention provides a simple, inexpensive, but yet effective manner for providing protective cover against detection.

While the burst charge method of fabrication described herein has been directed to screening the ingredients through a screen, other types of separators may be effectively used in this process.

While particular embodiments of the decoy rounds, an embodiment of a launcher mechanism, and specific methods for assembling the rounds and the burst charge have been illustrated and described, modifications and changes will become apparent to those skilled in the art, and it is intended to cover in the appended claims all such modifications and changes as come within the true spirit and scope of this invention.

What we claim is:

1. A method for producing a line type burst charge adapted for dispersing energy generating material in an effective pattern for confusing energy sensing devices comprising the steps of: screening potassium perchlorate through about a number twenty screen; mixing the screened potassium perchlorate with black aluminum in the ratio of about five parts by weight of potassium perchlorate to about two parts by weight of black aluminum; screening the mixture a predetermined number of times through about a number twenty screen, containing the mixture, and positioning a fusing member therein.

2. The method defined in claim 1, additionally including the steps of: mixing yellow dextrin, at a ratio of about one quarter part by weight to the previously mentioned parts by weight of the potassium perchlorate and black aluminum, with the screened potassium perchlorate and the black aluminum before the screening step of the mixture; adding water to the mixture at the rate of about one half quart to the above mentioned ratio by weight of the potassium perchlorate, black aluminum, and yellow dextrin; mixing the mixture; and forcing the thus mixed mixture through a screen of about one eighth inch at the time rate of once about every four hours until the mixture is dry.

3. The method defined in claim 2, wherein the predetermined number of times of the last mentioned screening step is three times.

4. The method defined in claim 2, wherein the fusing member is positioned in the contained mixture so as to extend centrally through substantially the entire length of the contained mixture.

5. The method defined in claim 2, additionally includes the step of constructing the material in such a manner as to provide the additional capability of radiating energy at a plurality of different frequencies.

6. The method defined in claim 1, wherein the predetermined number of times of the last mentioned screening step is three times.

7. The method defined in claim 1, wherein the fusing member is positioned in the contained mixture so as to extend centrally though substantially the entire length of the contained mixture.

8. A method for producing a line type charge adapted for dispersing energy generating material in an effective pattern for confusing energy sensing devices comprising the steps of: mixing potassium perchlorate of particle size capable of passing through a screen of about a number twenty size with black aluminum in the ratio of about five parts by weight of the screened perchlorate to about two parts by weight of the aluminum; passing the mixture a predetermined number of times through a separating means capable of passing material up to about the size which can be passed through about a number twenty screen; containing the mixture; and positioning a fusing member therein.

9. A method for assembling decoy rounds adapted for confusing energy sensing devices comprising the steps of: positioning a plug-like means in one end of an internal cavity extending through a load of energy generating material; securing the plug-like member with the cavity; wrapping at least one layer of suitable material around the load with sufficient material extending beyond the load to cover the ends thereof; securing the material; locating a burst charge within the load cavity and in abutment with the plug-like member; covering the ends of the load with suitable members; folding the extending material over the members; positioning additional members over the folded material; lacing the thus assembled unit with suitable material; applying at least one layer of suitable material around the laced unit and securing the same thereto; positioning ignitor means along side the thus assembled unit; wrapping suitable material around a portion of the unit and ignitor means which contains the plug-like member with the material extending past the end thereof; supplying a lift charge to within the area defined by the extending material; closing the extending material so as to contain the lift charge; operatively connecting a time fuse means with the ignitor means and the burst charge; covering the other portion of the unit and ignitor means and the time fuse means with suitable material; securing the covering material close to the end of load; operatively connecting a firing means with the ignitor means within an open end of the covering material; and securing the covering material over the firing means; wherein the burst charge is properly contained with respect to the load of energy generating material for effectively dispersing the load, and is isolated from the lift charge, while each of the ignitor means, fusing means and firing means is protected and thereby assured of proper operation.

* * * * *